United States Patent [19]

Baldyga

[11] 4,199,212

[45] Apr. 22, 1980

[54] SELF SEALING LAMP SOCKET

[75] Inventor: Joseph W. Baldyga, Mt. Clemens, Mich.

[73] Assignee: C. J. Edwards Company, Detroit, Mich.

[21] Appl. No.: 936,141

[22] Filed: Aug. 23, 1978

[51] Int. Cl.[2] ..... H01R 13/58

[52] U.S. Cl. ..... 339/107; 339/206 L; 339/210 T

[58] Field of Search ..... 339/59 R, 59 M, 59 L, 339/60 R, 60 M, 63 R, 63 M, 94 R, 94 L, 103 C, 103 B, 107, 176 L, 206 R, 206 P, 208, 209, 210 R, 210 M, 210 T, 188 R, 188 C

[56] References Cited

U.S. PATENT DOCUMENTS

| | | | |
|---|---|---|---|
| 817,346 | 4/1906 | Stakelbeck | 339/107 |
| 1,910,306 | 5/1933 | Pullon | 339/206 L |
| 2,470,280 | 5/1949 | Ackerman | 339/188 R |
| 3,272,913 | 9/1966 | Crimmins et al. | 339/107 |
| 3,383,637 | 5/1968 | DeLano | 339/209 |
| 3,518,617 | 6/1970 | Bosworth et al. | 339/107 |

FOREIGN PATENT DOCUMENTS

| | | | |
|---|---|---|---|
| 1640302 | 4/1970 | Fed. Rep. of Germany | 339/208 |

*Primary Examiner*—Neil Abrams

*Attorney, Agent, or Firm*—Neal A. Waldrop

[57] ABSTRACT

The invention comprises an assembled electrical lamp socket construction having novel integral sealing means for the tower end derived from axial installation of a split plug wedging compressively within an outer socket shell and against insulation of wiring passing therethrough to retain electrical circuit contact assemblies in the tower. The plug is inserted with interengaging tapered surfaces in the tower end of the socket shell producing snap-in fit for the circumferential compressive engagement of the plug with the shell and a second interference compressive fit for the mating surfaces of the split plug halves. Apertures for insulated electric wires are formed in the mating surfaces with circumferential protrusions that encapsulate and compressively penetrate the wire insulation to form a seal thereabout. The tower preferably constructed of suitable non-conductive plastic material thereby prevents the entrance of moisture and debris into the socket through simple snap assembly without the need for external boots, potting compound or other additional sealing means.

10 Claims, 3 Drawing Figures

SELF SEALING LAMP SOCKET

BACKGROUND OF THE INVENTION

The field of the invention is electrical equipment, in particular, electric lamp sockets usually used in twelve volt motor vehicle or other lighting or electrical systems. The particular sockets of interest are inserted in holes in the back or side walls of light assemblies on the vehicle. A light assembly usually comprises a chamber having a plastic lens that is sealed with a gasket. A gasket is fitted about the hole where a socket is inserted. The lamp and lamp end of the socket are inside the chamber and therefore protected against moisture and debris. The portion of the socket extending outside of the chamber, commonly referred to as the tower, provides support and connection means for the electric circuit leading to the lamp.

In locations where the tower is exposed to the elements it must also be sealed to prevent the ingress of moisture and debris. Otherwise the socket is subject to premature failure from moisture and corrosion. Some prior art sockets in common use are sealed with separate external boots through which the electric wires are inserted. In other sockets the openings for the wires are sealed with a potting compound. The booted tower construction normally contains additional mechanical contacts in the electric circuits where the wires are plugged into the tower. Such construction results in voltage drops in the circuits that are undesirable and should be minimized. The potted tower requires an expensive masking procedure during assembly to prevent the fluid potting compound from interfering with the operation of the flexible lamp contacts within the socket.

SUMMARY OF THE INVENTION

The new lamp socket comprises a non-conductive shell adapted to receive a lamp in one end and a non-conductive split plug in the opposite tower end. The multiple plug segments preferably formed as halves include cavities for the electrical contact assemblies that engage the base of the lamp. The contact assemblies are permanently crimped to wires, insulated extensions of which in turn pass through apertures formed in the internal abutting surfaces of the plug segments.

The shell and the plug segments are formed with integral sealing means that tightly interengage through axial assembly of the components. The inner circumference of the tower end of the shell includes a tapered notch and the exterior circumferential surface of the plug is formed with a complementary tapered protrusion sized for an interference fit with the shell to provide a compression moisture and debris proof seal when snapped together. The abutting surfaces of the plug segments include a slot and mating protrusion sized for an interference fit. Each wire aperture is formed with circumferential protrusions that engage or encapsulate the wire insulation to form a seal thereabout when compressed in assembly. The socket parts are snapped together with the contact assemblies positioned in the cavities. Upon assembly the integral sealing means provide the required moisture and debris protection without the need for gaskets, external boots or potting compounds.

DESCRIPTION OF THE PREFERRED EMBODIMENT

Figure 1:
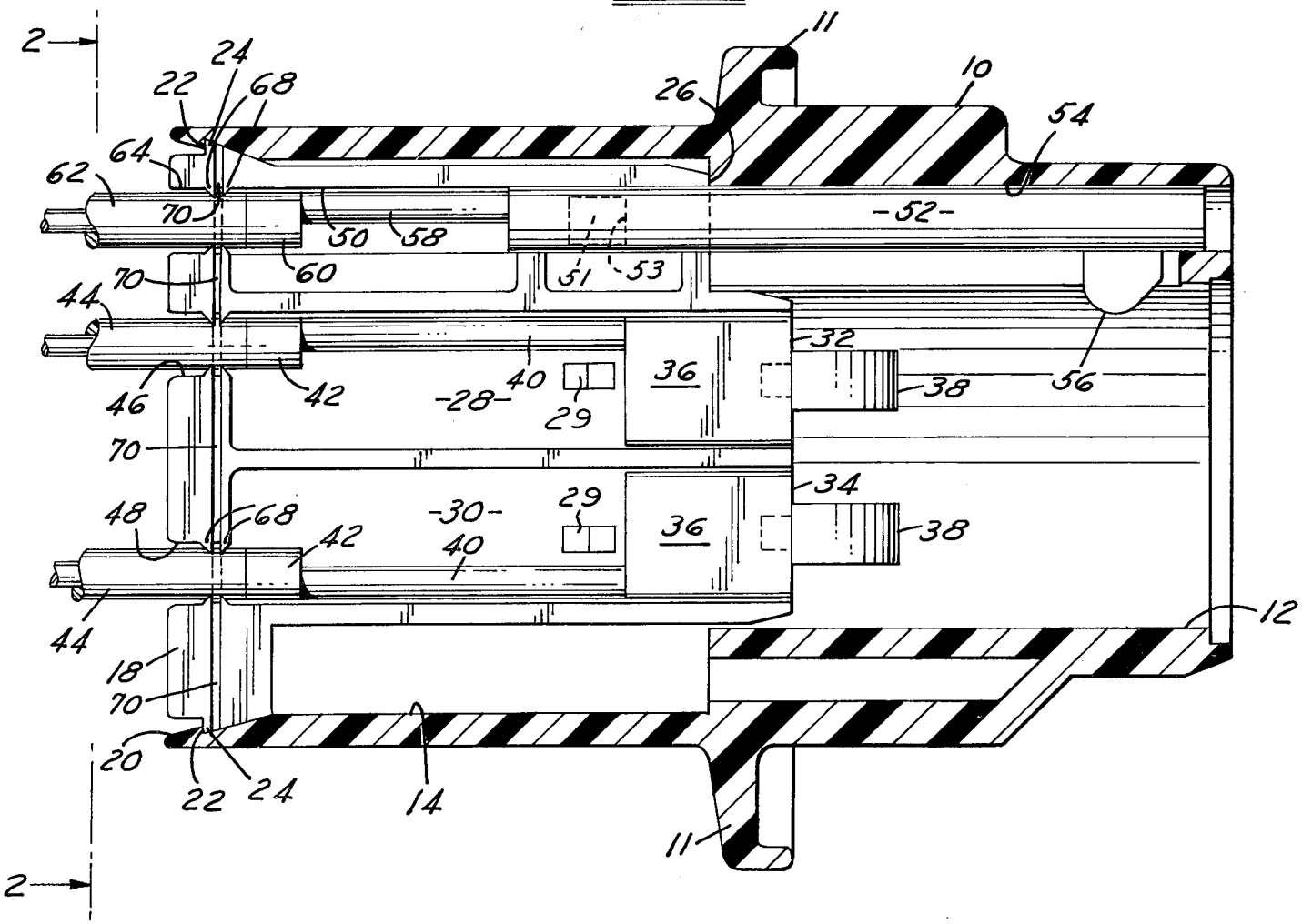
FIG. 1 is a side cross section of the lamp socket taken along the line 1—1 of FIG. 2.
Figure 2:
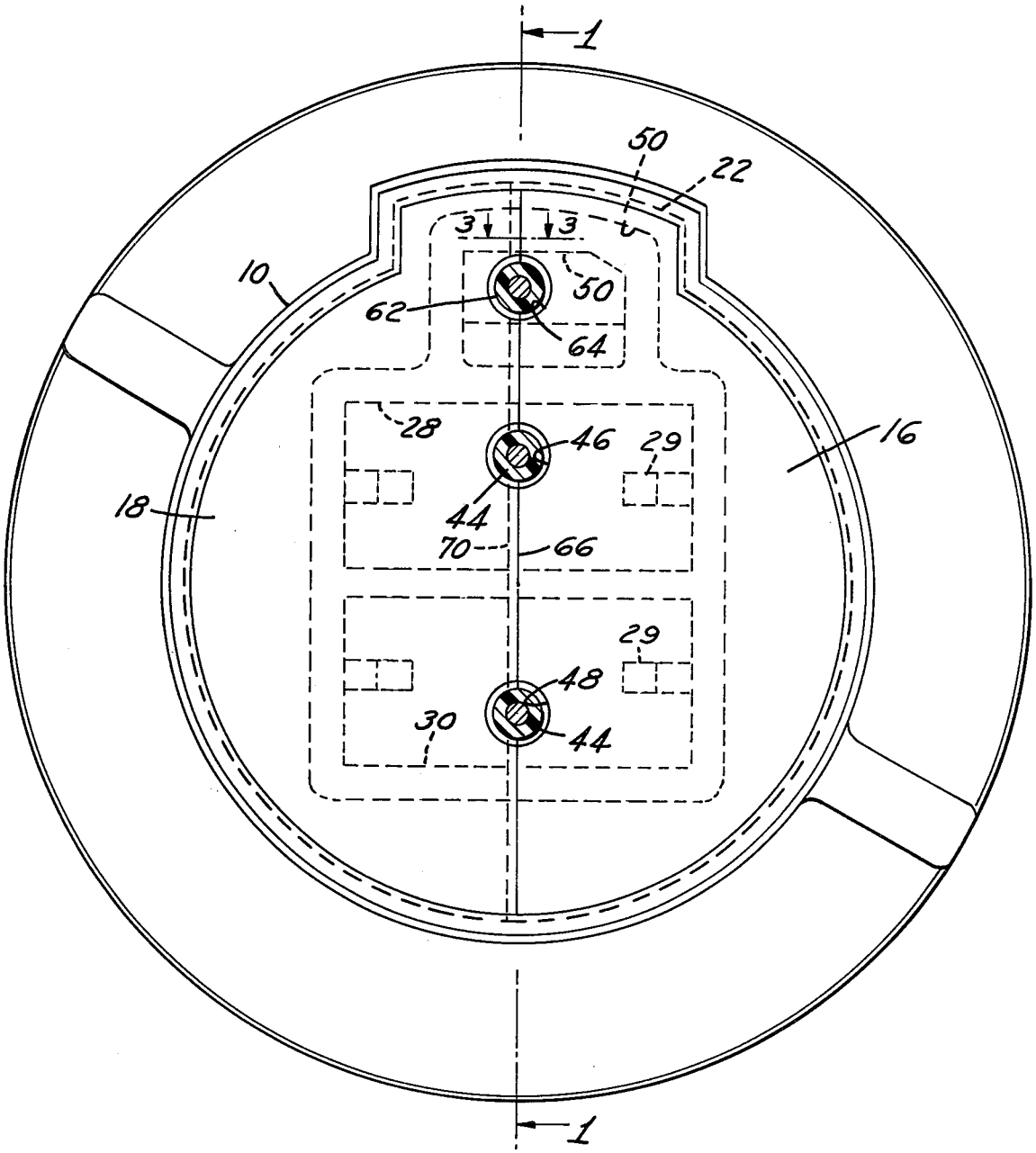
FIG. 2 is a tower end view of the lamp socket taken along the line 2—2 in FIG. 1.

As shown in FIGS. 1 and 2 the lamp socket is substantially cylindrical in shape. An outer hollow shell 10 is formed with a cylindrical lamp opening 12 suitable for the insertion of a lamp (not shown). Such sockets are used in motor vehicles to retain single or dual filament twelve volt lamps for tail lights, stop lights, turn signals and the like. An external flange 11 is formed about the shell 10 to retain a gasket and engage attachment means adjacent the periphery of a hole into which the lamp and socket are inserted.

Typically the metal base of a twelve volt lamp includes two lugs adapted to lock the lamp into the socket upon insertion. The lugs engage bayonet type slots in the side wall of the lamp opening 12. Such construction is commonly used. In contrast, the socket construction disclosed herebelow, which is not limited to motor vehicle twelve volt electrical systems, employs simplified, inexpensive sealing means for the tower end of the lamp socket that easily and effectively seal out moisture and debris.

At the tower end of the shell 10 an aperture 14 is formed and is in communication with the opening 12. The two halves 16 and 18 of a plug are positioned within aperture 14. The shell 10 and the plug halves 16 and 18 are preferably molded of a plastic that is weather resistant and electrically insulating. The entrance to the aperture 14 is tapered as shown at 20 and includes an undercut tapered notch 22 extending about the entrance. Each of the plug halves 16 and 18 is formed with a complementary tapered protrusion 24 sized for an interference fit in the notch 22. The taper 20 assists in snapping the plug halves into the shell. A shoulder 26 or other stop is provided within the shell 10 to engage the inner end surfaces of the plug halves and to cause engagement of the protrusion 24 thereon with the notch 22 as the plug halves are inserted.

The plug halves 16 and 18 are provided with cavities 28 and 30 for receiving contact assemblies 32 and 34. Each contact assembly comprises a metal shell 36 which retains a flexible metal contact strip 38 adapted to engage a metal filament contact point on the base of a lamp, and includes a metal tongue 40 which is crimped at 42 about the exposed end of an insulated wire 44. The wires 44 extend outwardly through wire apertures 46 and 48 from the cavities 28 and 30. In a similar manner the plug halves 16 and 18 can be formed with a single cavity and wire aperture for a single contact assembly. A single cavity and contact assembly are positioned to contact the single center contact point of a single filament lamp.

Plug halves 16 and 18 are also provided with a third cavity 50 which houses ground contact assembly 52, that extends inwardly into passage 54 adjacent the lamp opening 12. Ground contact assembly 52 includes a flexible metal contact strip 56 which engages the metal shell at the base of a lamp and is electrically connected to ground wire 62 by metal tongue 58, as by crimping at 60. Ground wire 62 extends outwardly from the cavity 50 through aperture 64.

The metal contact assemblies 32, 34, and 52, as shown, are for illustrative purposes only. Other contact assembly constructions may be conveniently substituted when the socket is assembled. In one satisfactory option the cavities 28, 30 and 50 may contain stubs 29 and 51 which extend from the cavity sidewalls to provide support for the contact assemblies 32, 34 and 52 when a lamp is positioned against the contact strips 38 and 56. The stub 51 extends into a depression 53 in the assembly 52.

Figure 3:
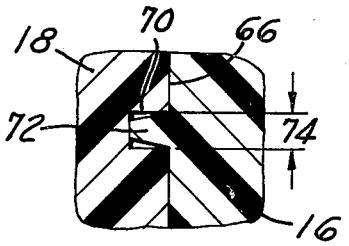
FIG. 3 is a partial cutaway section taken along the line 3—3 of FIG. 2 to show a sealing detail.

The wire apertures 46, 48 and 64 are each bisected by the mating surfaces 66 of the plug halves 16 and 18. The first portion of the seal to prevent the entrance of moisture and debris in the socket of this invention is provided at the mating surfaces 66, as shown in cross section in FIG. 3. A slot 70 is provided slightly below the level of the top surface of protrusion 24 in plug half 18; slot 70 extends across the full width of plug 18 and terminates in pressure contact with the inner surface of the tapered wall of the tower end of shell 10. Plug half 16 is provided with tongue, or protrusion, 72 which is slightly tapered, as shown, and adapted to fill and form and interference fit and seal with the walls of slot 70 and shell 10 when halves 16 and 18 are assembled into shell 10.

The second portion of the seal between socket components is formed about the outwardly extending portions of wires 44 and 62 within aperture 46, 48 and 64 as the plug halves 16 and 18 are pressed into the tower end of shell 10. Each plug half 16 and 18 is provided with circumferentially inwardly extending protrusion 68 adjacent to either side of slot 70 and tongue 72, as shown. Protrusion 68 surround and form a pressure engagement fit with the insulation on wires 44, 62 as they are compressed into circular cross-section as plug halves 16, 18 are axially inserted into cavity 14 due to the forces resulting from movement of tapered protrusion 24 along tapered surface 22 as the plug halves are snapped into the tower end of shell 10 and into engagement with shoulder 26 and notch 22. Shell 10 may be fabricated from a variety of non-electrically conductive materials such as hard rubber, plastics that are formable by injection molding such as polyethylene, polypropylene, ABS, impact polystyrene and the like; it is only necessary to select a material having the capacity to be readily and simply fabricated into the desired shapes and to present sufficient strength and resilience to effect the seals in slot 70 and by compression of protrusions 68 into the insulation on wires 44, 62 when plug halves 16, 18 are assembled, as described, into the tower end of shell 10. The most desirable material is one which in a relatively thin wall section has a high degree of resistance to outward radial expansion to thereby provide maximum compressive force on tongue 72 and protrusions 68 during assembly. Polypropylene is a preferred material for shell 10 for use in this invention.

Assembly of the plug halves 16, 18 to form the sealed socket of this invention is preferably accomplished by positioning the contact assemblies 32, 34 and 52 having wires 44, 62 attached thereto in cavities 28, 30 and overlaying the other plug half therearound. The sub-assembly is then axially inserted, as above explained, until the circumferential protrusion snaps into notch 22 and the inner end engages shoulder 26. When so assembled the component halves 16 and 18 are sealed together and wires 44 and 62 are sealed in their apertures. Disassembly for repair, if necessary, is easily accomplished by springing open the tower end of shell 10 and sliding halves 16, 18 axially outwardly.

I claim:

1. A sealed electric lamp socket comprising a non-conductive hollow shell housing having a lamp socket end and a tower end; a plug in said tower end having electric wire passage means extending therethrough; said plug formed from a plurality of segments having adjacent interfaces including said passage means therebetween; and sealing means adapted for engagement between the outer perimeter of said plug segments and inner perimeter of said tower, sealing means between said segments extending across their interfaces to the inner perimeter of said tower, and sealing means between the interfaces of said segments and interposed wire, all of said sealing means being rendered effective by assembly insertion of said plug segments into said tower end.

2. A lamp socket in accordance with claim 1 wherein said sealing means is integrally formed in said tower end and plug elements.

3. A lamp socket in accordance with claim 2 wherein said plug is formed with two interfitting pieces.

4. A lamp socket in accordance with claim 3 including electrical wiring having attached electrical terminal connection means and said plug including locating cavity means therefor.

5. A lamp socket in accordance with claim 2 including tapered wedging means operative upon insertion of said plug within said tower end to produce effective compressive engagement of said sealing means.

6. A lamp socket in accordance with claim 5 including snap lock retention means integrally formed in the interengaging tower end and plug elements.

7. A lamp socket according to claim 2 wherein said shell is generally cylindrical and said plug segments are substantially semi-cylindrical with generally planar interfaces including said passage means extending into each of said interfaces.

8. A lamp socket in accordance with claim 2 said passage means including a ridge protrusion means for compressively engaging interposed insulated wire.

9. A lamp socket in accordance with claim 2 wherein said sealing means includes a compressed annular ridge engagement means between said tower end and plug elements.

10. A lamp socket in accordance with claim 2 wherein said sealing means includes interengaging groove and protrusion means formed in the interfaces of said plug elements.

* * * * *